United States Patent [19]

Wolf et al.

[11] 4,036,587

[45] July 19, 1977

[54] PROCESS FOR DYEING CELLULOSE FIBERS

[75] Inventors: Hans Wolf, Ludwigshafen; Jozsef Gerendas, Neustadt; Ernst Wilhelm, Ludwigshafen, all of Germany

[73] Assignee: BASF Aktiengesellschaft, Ludwigshafen (Rhine), Germany

[21] Appl. No.: 609,562

[22] Filed: Sept. 2, 1975

[30] Foreign Application Priority Data

Sept. 19, 1974 Germany ..... 2444823

[51] Int. Cl. ..... C09b 69/00

[52] U.S. Cl. ..... 8/92; 8/18 A

[58] Field of Search ..... 8/18, 18 A, 92

[56] References Cited

U.S. PATENT DOCUMENTS 1,976,679 10/1934 Fikentscher et al. ..... 8/18 A

FOREIGN PATENT DOCUMENTS 240,259 12/1959 Australia ..... 8/18

1,209,241 10/1970 United Kingdom ..... 8/18 A

*Primary Examiner*—Joseph L. Schofer

*Assistant Examiner*—William E. Schulz

*Attorney, Agent, or Firm*—Keil, Thompson & Shurtleff

[57] ABSTRACT

A process for dyeing cellulose fibers and mixtures of the same with synthetic fibers in an aqueous liquor by the exhaustion method in the presence of a water-soluble polymer of acrylic acid or an alkali metal salt or ammonium salt thereof, an alkali metal or ammonium salt of a copolymer of maleic acid and styrene, maleic acid and a vinyl ester or maleic acid and a vinyl ether as a dyeing assistant in an amount of from 0.05 to 2% by weight based on the material being dyed. Level dyeings are obtained and mixtures of fibers can be dyed in a single liquor.

6 Claims, No Drawings

PROCESS FOR DYEING CELLULOSE FIBERS

The invention relates to a process for dyeing cellulose fibers and mixtures of the same with synthetic fibers in an aqueous liquor by the exhaustion method in the presence of dyeing assistants.

Textile material containing cellulose fibers is frequently subjected to an acid pretreatment to obtain better dyeing of the cellulose fibers. Such an acid purification of the textile material is included for example in acid polyester dyeing processes which usually precede the dyeing of mixtures of cotton and polyester. The acid pretreatment substantially removes impurities and natural constituents from the cellulose fibers, for example calcium and magnesium salts, pectins and hemicelluloses. It is more economical however to continue dyeing in the same liquor. This is only possible if the constituents of the cellulose which have been dissolved out can be held in solution or suspension not only in an acid medium but also in an alkaline medium so that separation of the constituents is prevented. For this purpose modified lignin sulfonates or certain complexing agents such as nitrilotriacetic acid or ethylenediaminotetraacetic acid or polyphosphates have hitherto been added to the liquors. These additives only give the desired effect however when they are used in a high concentration.

It is an object of the invention to improve the methods described above so that no impurities or natural constituents separate out from the cellulose during dyeing, particularly in the alkaline range.

This object is achieved in accordance with the invention by using as the dyeing assistant and complexing agent a water-soluble polymer of acrylic acid or an alkali metal or ammonium salt thereof and/or an alkali metal or ammonium salt of a copolymer of maleic acid and styrene, maleic acid and a vinyl ester and/or maleic acid and a vinyl ether.

Polymers of acrylic acid include homopolymers and copolymers of acrylic acid with other ethylenically unsaturated compounds. The copolymers of acrylic acid may contain up to 50% by weight of ethylenically unsaturated compounds which can be copolymerized with acrylic acid for example methacrylic acid, methacrylamide, acrylamide, acrylonitrile, methacrylonitrile, acrylates, methacrylates and other ethylenically unsaturated monocarboxylic or dicarboxylic acids, for example crotonic acid and itaconic acid. The copolymers preferably contain from 1 to 20% by weight of the comonomers; they may also contain polymerized units of more than one comonomer, for example copolymers of acrylic acid, acrylonitrile and acrylamide. The copolymers in question are known and they are obtained by polymerization of acrylic acid or by copolymerization of acrylic acid with one or more appropriate comonomers. It is essential that polymers which are soluble in water should be used. The alkali metal or ammonium salts of the polymers of acrylic acid may be used as well as the said water-soluble polymers of acrylic acid. These salts are obtained either by polymerization of the alkali metal or ammonium salts of acrylic acid alone or mixed with suitable comonomers or by neutralization of the polymers with an alkali metal hydroxide, ammonia or an amine. It is preferred to use the sodium salt but the lithium and potassium salts are also suitable. Examples of amines which may be used to form ammonium salts are: methylamine, ethylamine, dimethylamine, diethylamine, triethylamine, diethanolamine, triethanolamine and the like.

The salts of copolymers of maleic acid and styrene, of maleic acid and a vinyl ester and of maleic acid and a vinyl ether have proved to be very effective additives according to this invention. It is preferred to use vinyl acetate and vinyl propionate as the vinyl esters. Examples of suitable vinyl ethers are $C_1$ to $C_4$ alkyl vinyl ethers such as methyl vinyl ether, n-propyl vinyl ether, isopropyl vinyl ether, n-butyl vinyl ether and isobutyl vinyl ether. The maleic acid and the comonomers in the said copolymers are mainly present in a molar ratio of 1:1. They are used in the form of their alkali metal or ammonium salts. For example mixtures of polyacrylic acid and the sodium or ammonium salt of a copolymer of maleic acid and styrene may be used as a dyeing assistant according to the invention. Suitable polymers of acrylic acid and maleic acid have a viscosity (measured with the falling ball viscometer according to Höppler at 20° C according to DIN 53,015) of from 1 to 300 centipoises in a 7.5% by weight solution in water which has been adjusted to a pH of 9 with caustic soda solution. The viscosity of suitable polymers is preferably from 3 to 120 centipoises measured according to DIN 53,015.

The polymeric assistant to be used according to the invention is in general used in an amount of from 0.05 to 2% and preferably from 0.1 to 1% by weight based on the weight of materials to be dyed. The process is not limited to any particular form of textile material but may be used for dyeing yarns and also for dyeing wovern or knitted goods. The cellulose may be in the form of raw cotton, linen, hemp or as native cellulose fiber. The process according to the invention has special importance in the dyeing of fiber mixtures of cotton with synthetic fibers, particularly raw cotton and polyester fibers. Even iin the case of fiber mixtures dyeing may be carried out in a single liquor, for example by first dyeing the polyester component of the fiber mixture and then, in the same liquor, dyeing the cotton component, for example at a temperature of from 40° to 90° C, by adding a dye suitable for dyeing cotton.

For dyeing cellulose fibers those dyes known for the purpose may be used, for example vat dyes, reactive dyes, substantive dyes and sulfur dyes. The cellulose fibers are dyed at a temperature of from ambient temperature to about 130° C. Dyeing is carried out in an aqueous liquor by the exhaustion method. The liquor contains the appropriate dye, the polymerized dyeing assistant to be added according to the invention and if desired conventional assistants such as leveling agents and dispersing agents. For dyeing mixtures of polyester and cotton, dye mixtures of a vat or sulfur dye and a disperse dye may be added to the liquor from the start. By means of the last-mentioned dye mixtures it is possible for example to dye union fabric or blended yarn from raw cotton and polyester fibers in a single liquor by first dyeing the polyester component in a weakly acid range with a disperse dye at a temperature above 120° ) C and then dyeing the cotton component with a vat or sulfur dye in the alkaline range at a temperature of from 20° to 100° C.

The invention will be illustrated in greater detail in the following Examples. The viscosities given in the Examples are measured in a 7.5% by weight aqueous solution (adjusted to pH 9 with caustic soda solution) with a falling ball viscometer according to Höppler at a temperature of 20° C according to DIN 53,015.

Dyeing Recipe 600 g of raw cotton yarn is treated in a laboratory dyeing machine on cones in a mixture of 8000 ml of water and 40 ml of 30% acetic acid at 100° C for 30 minutes. The boiled liquor is then cooled to 60° C and a dyeing assistant as specified in Examples 1 to 5 is added. in addition to the dyeing assistant specified in the Examples there are added 96 ml of 32.5% by weight caustic soda solution, 12 g of the reaction product of sodium dithionite with 2 moles of acetaldehyde, 26 g sodium dithionite and 12% of the yellow vat dye C.I. No. 70600 is standard commercial form. The temperature is then raised rapidly to 95° C. After a period of 30 minutes at 95° C the liquor is cooled to 80° C and 12 g of sodium dithionite is added. The liquor is then cooled within ten minutes to a temperature of 60° C and the dyed material is rinsed as usual, oxidized and soaped at the boil with the addition of 0.3 g/l of diethanolammonium dodecylbenzene sulfonate, 1 g/l of sodium carbonate and 0.2 g/lof the reaction product from nonylphenol and 10 moles of ethylene oxide for thirty minutes.

EXAMPLE 1

Raw cotton yarn is dyed according to the instructions given above and a monosodium salt of the copolymer from styrene and maleci acid in the molar ratio 1:1 is used as the dyeing assistant according to the invention. The copolymer has a viscosity of 30 centipoises and is used in an amount of 1.6 g. A level dyeing is obtained.

Comparative Example 1

The procedure of Example 1 is repeated but the sodium salt of ethylenediaminetetraacetic acid is used instead of the copolymer of styrene and maleic acid. In order to obtain a level dyeing without deposits on the cones it is necessary to use the dyeing assistant in an amount of at least 6.4 g. When an amount of only 1.6 g is used on the other hand a brownish precipitate is deposited on the yarn. The dyeing is not fast to crocking and not level.

EXAMPLE 2

The procedure described in Example 1 is repeated but a sodium polyacrylate having a viscosity of 3.6 centipoises in an amount of 1.6 g as the dyeing assistant. A satisfactory dyeing is again obtained.

EXAMPLE 3

The procedure described in Example 1 is repeated but a polyacrylic acid having a viscosity of 29 centipoises is used in an amount of 1.6 g as the dyeing assistant according to the invention. The dyeing is clear and level.

EXAMPLE 4

The procedure described in Example 1 is repeated but a copolymer of 70 mole% of acrylic acid and 30 mole% of acrylamide having a viscosity of 170 centipoises is used in amount of 2.4 g as the dyeing assistant according to the invention. The dyeing is clear and level.

EXAMPLE 5

The procedure described in Example 1 is repeated but a copolymer of acrylic acid and methacrylic acid in a molar ratio of 1:1 and having a viscosity of 11 centipoises is used in an amount of 2.4 g as the dyeing assistant according to the invention. The dyeing is clear and level.

EXAMPLE 6

600 g of raw cotton yarn wound on cones is treated in a laboratory dyeing machine in 8000 ml of water with an additional of 40 ml of 30% acetic acid at a temperature of 100° C for 30 minutes. The boiled liquor is then cooled to a temperature of 60° C and the following substances are added: 1.6 g of sodium polyacrylate having a viscosity of 3.6 centiposes, 3 g of the reactive dye C.I. No. 18097, 320 g of sodium sulfate and 4 ml of 32.5% by weight caustic soda solution. After the raw cotton has been dyed for twenty minutes at a temperature of 60° C there are added to the liquor 16 g of sodium bicarbonate and 4 ml of 32.5% by weight caustic soda solution and dyeing is continued for another forty minutes at a temperature of 60° C. After another 12 ml of caustic soda solution (32.5% by weight) has been added dyeing is continued for another 20 minutes at a temperature of 60° C. Another 12 ml of caustic soda solution is again added (32.5% by weight) and dyeing is again continued for another 40 minutes at a temperature of 60° C. The dyeing is then given a cold rinse, neutralized with acetic acid, rinsed hot at 70° to 80° C and then dried. The dyeing is level and deposits of dye or impurities on the cones cannot be detected.

Comparative Example 2

The procedure described in Example 6 is repeated but instead of the sodium polyacrylate according to the invention 8 g of polyphosphate is used as dyeing assistant. An uneven dyeing is obtained. Dye and impurities enriched with dye have been deposited on the walls of the dyeing machine.

We claim:

1. A process for the dyeing of cellulose fibers or mixtures of cellulose fibers with synthetic fibers which comprises dyeing a textile material made of said cellulose fibers or said mixtures of fibers by the exhaustion method in an aqueous liquor that had been used in the acid pre-treatment of said fibers and containing a dye for cellulose fibers and, as a dyeing assistant and complexing agent, from 0.05 to 2% by weight, based on the material being dyed, of a water-soluble polymer selected from the group consisting of water-soluble homopolymers of acrylic acid, water-soluble copolymers of acrylic acid with up to 50% by weight of methacrylic acid, methacrylamide, acrylamide, acrylonitrile, methacrylonitrile, esters of acrylic acid and methacrylic acid, crotonic acid and itaconic acid, copolymers of maleic acid with styrene, copolymers of maleic acid with vinyl esters, copolymers of maleic acid with vinyl ethers and the alkali metal and ammonium salts of the said polymers, said polymer having a viscosity of 7.5% by weight solution of the polymer in water at a pH of 9 and a temperature of 20° C of from 1 to 300 centipoises.

2. A process as claimed in claim 1 wherein the dyeing assistant is used in an amount of from 0.1 to 1% by weight based on dyed material.

3. A process as claimed in claim 1 wherein the viscosity of a 7.5% solution of the polymer in water at a pH of 9 and a temperature of 20° C is from 3 to 120 centipoises.

4. A process as claimed in claim 1 wherein the dyeing assistant is selected from sodium polyacrylate, polyacrylic acid, a copolymer of acrylic acid with acrylamide, a copolymer of acrylic acid with methacrylic acid and a copolymer of styrene and maleic acid.

5. A process as claimed in claim 1 wherein said textile material is raw cotton yarn.

6. A process as claimed in claim 1 wherein said fibers are raw cotton yarn fibers.

* * * * *